US006997230B2

(12) United States Patent
Niehausmeier

(10) Patent No.: US 6,997,230 B2
(45) Date of Patent: Feb. 14, 2006

(54) FOLDING DEVICE AS ROOM DIVIDER OR ROOM CLOSURE

(75) Inventor: Uwe Niehausmeier, Rödinghausen (DE)

(73) Assignee: Solarlux Aluminium Systeme GmbH, Bissendorf (DE)

( * ) Notice: Subject to any disclaimer, the term of this patent is extended or adjusted under 35 U.S.C. 154(b) by 456 days.

(21) Appl. No.: 10/249,972

(22) Filed: May 23, 2003

(65) Prior Publication Data

US 2003/0217818 A1 Nov. 27, 2003

(30) Foreign Application Priority Data

May 24, 2002 (DE) ..... 102 23 263
Aug. 1, 2002 (DE) ..... 102 35 301

(51) Int. Cl.
*E06B 3/48* (2006.01)

(52) U.S. Cl. ..... 160/118; 160/206; 52/71

(58) Field of Classification Search ..... 160/40, 160/118, 117, 119, 199, 206, 209; 52/71, 52/65; 49/475.1
See application file for complete search history.

(56) References Cited

U.S. PATENT DOCUMENTS 3,994,330 A * 11/1976 Laby ..... 160/199
4,133,365 A * 1/1979 Schleicher ..... 160/118
5,042,554 A * 8/1991 Schmidt ..... 160/199
5,085,261 A * 2/1992 Bortoluzzi ..... 160/199
5,085,262 A * 2/1992 Tutikawa ..... 160/199
5,199,478 A * 4/1993 Kubota ..... 160/40
5,299,791 A * 4/1994 Schlapp ..... 296/219
6,220,332 B1 * 4/2001 Lai ..... 160/199

* cited by examiner

*Primary Examiner*—Blair M. Johnson
(74) *Attorney, Agent, or Firm*—Gudrun E. Huckett

(57) ABSTRACT

A folding device as a room divider or room closure has at least one wing chain of interconnected wings that upon opening of the folding device are folded against one another. One wing side has guide elements providing pivot axes received in guide rails such that the wings are slidably guided. One wing is an opening wing connected only to a single neighboring wing and has a free wing edge guided in the guide rails. At least one guide rail has a stop across which the wings cannot move. The free wing edge has a profiled strip at a side facing the stop. The profiled strip projects past the pivot axis of the guide element provided at the free wing edge and has a slanted portion facing the stop and slanted in a direction toward the free wing edge. The slanted portion extends at least across the stop height.

8 Claims, 6 Drawing Sheets

FOLDING DEVICE AS ROOM DIVIDER OR ROOM CLOSURE

BACKGROUND OF INVENTION

1. Field of the Invention

The invention relates to a folding device, in particular, a folding device with glass panes, comprised of wings having peripheral metal profiles filled preferably with glass panes and a peripheral frame usually comprised of metal profiles, for room dividers or room closures to be opened and closed as needed, for example, for sunrooms, business entrances, balcony enclosures or the like. The folding device comprises a series of wings connected to one another to form at least one wing chain, wherein the wings, for opening the device, are folded against one another, wherein each wing is pivotably connected to a neighboring wing within the wing chain and is slidably guided with one side, respectively, by means of guide elements forming a pivot axis in guide rails or is secured on lateral frames in a non-slidable but pivotable way. At least one wing is an opening wing being connected only with one side to a neighboring wing and having a free wing edge on the opposite side that is guided in the guide rails.

2. Description of the Related Art

In principle, such folding devices have one or several pivotable and slidably connected wing chains so that a large front of a building or a room divider can be opened almost completely. Within the wing chain, each wing is pivotably connected to the neighboring wing but is guided slidably only with one side in the guide rails. The outer wings of a wing chain are either configured as opening wings, having one side without connection to another neighboring wing, or are secured pivotably and usually non-slidable on a lateral frame. When the opening wing is an individual wing, it can be configured simply as a rotary wing wherein the side connected to the neighboring wing is guided in the guide rails while the free wing edge is pivoted out of the plane which is formed by the guide rails and the lateral frame.

On the other hand, when the opening wing of the folding devices of the aforementioned kind is part of a double wing, i.e., a wing of a wing pair, its free edge must be guided in the guide rail. In particular in the area where the opening wing with its free wing edge abuts the lateral frame or an additional wing, but also across the entire length of the guide rails, such folding devices often have gaps causing draft. Even when these gaps are closed by flexible seals, these areas still provide points of attack for burglary tools and are therefore weak points with respect to safety in connection with burglaries. Moreover, the gaps or optionally employed seals visually contrast with the wing frames and the peripheral frame of the folding device and therefore impair the visual appearance of the folding device.

SUMMARY OF INVENTION

It is an object of the present invention to configure a folding device of the aforementioned kind such that the aforementioned disadvantages are avoided and, in particular, with respect to visual appearance and safety in connection with burglaries, an improved configuration is provided.

In accordance with the present invention, this is achieved in that at least one of the guide rails has at one side a stop, wherein the wings cannot move past the stop, and in that the free wing edge of the opening wing at this side has a profiled strip projecting past the pivot axis of the guide element provided at this location and being immobile relative to the opening wing, wherein the profiled strip is slanted in a direction toward the free wing edge at least across the height of the stop.

By configuring the guide rail with a stop across which the wings cannot move, points of attack for burglary tools are already covered in this area and, moreover, draft protection is improved. Also, brush seals or similar seals which are optionally provided in this area are covered from view by the stop.

Even though other folding devices are known which already have guide rails with stops, these known folding devices have the problem that on the free wing edge of the opening wing at the transition to the neighboring wing or to the lateral frame a gap or a wide, visually unpleasant seal must remain because the free wing edge otherwise would collide with the stop of the guide rail upon opening and pivoting the wing. Other folding devices are known which have a profiled strip covering the gap but cannot be provided with stop because of the aforementioned collision risk.

In the folding device according to the invention, these mutually exclusive features of the prior art are now combinable in that the free wing edge of the opening wing has a profiled strip which is slanted in the direction toward the free wing edge at least in the area of the stop of the guide rail. This slanted portion prevents collision with the stop of the guide rail. In this way, the area of the free wing edge of the opening wing is also improved with respect to draft protection and burglary protection.

The slanted portion of the profiled strip can be configured preferably such that it is rounded at a radius which originates at the pivot axis of the guide element. In this way, a continuous or uniform transition to the planar area of the opening wing is provided and a maximum coverage without the risk of collision at the stop of the guide rail is provided.

DETAILED DESCRIPTION

Figure 1A:
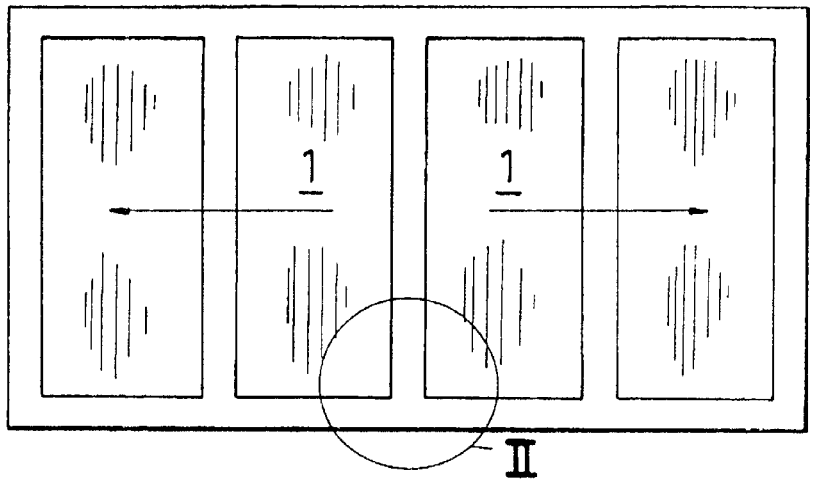
FIGS. 1*a–e* show schematically a folding device having four wings in a closed position in a view from the exterior and, in section, in several closing and opening positions.
Figure 1B:
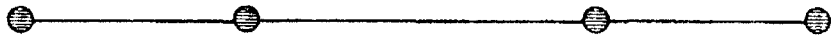
Figure 1C:
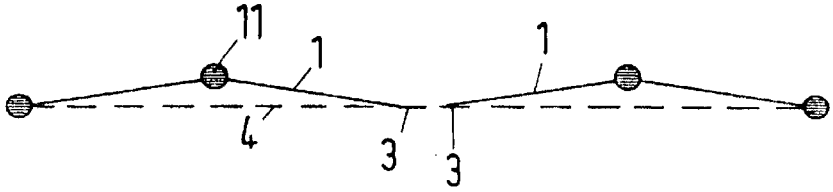
Figure 1D:
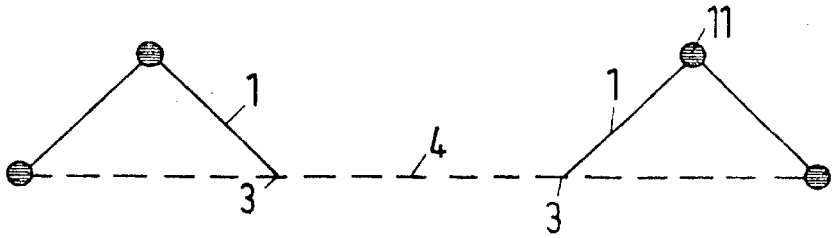
Figure 1E:
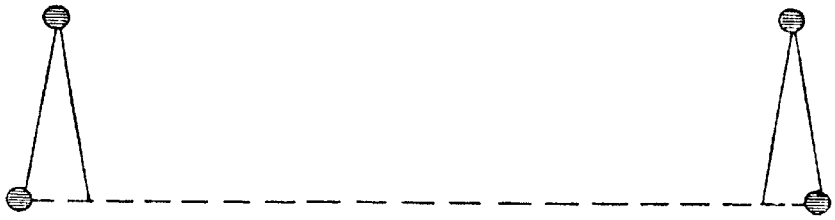

FIG. 1*a* shows a four-wing folding device with two wing pairs. Opening of this device is illustrated in pictograms in FIGS. 1*b* through 1*e*. The two free wing edges 3 of the opening wing 1 always remain in the plane 4 defined by the guide rails (not illustrated); this plane is indicated by dashed lines.

Figure 2:
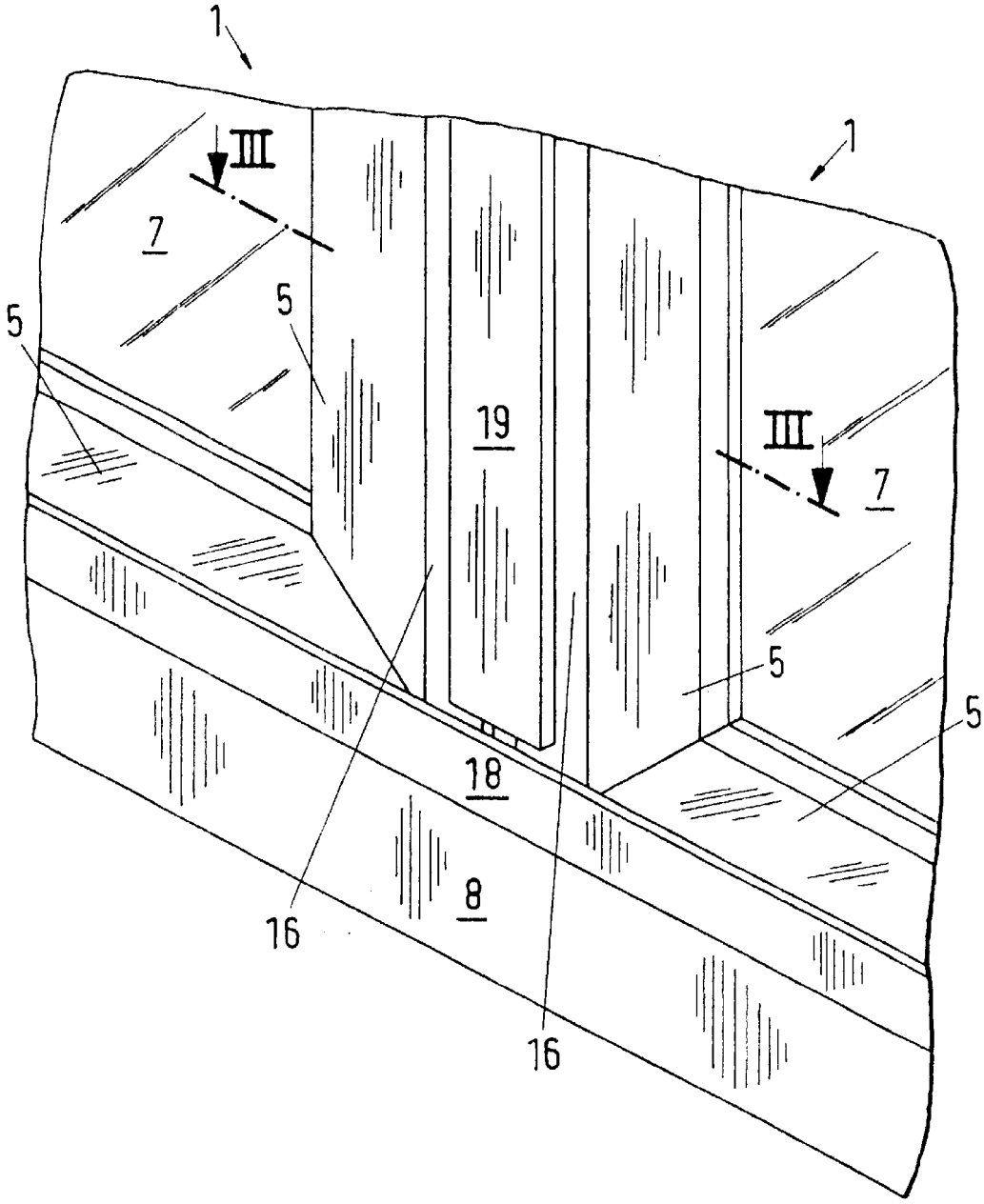
FIG. 2 shows the lower central opening area, corresponding to detail II of FIG. 1, in a perspective illustration.

FIG. 2 shows the lower central area of the two abutting free edges 3 of the opening wings 1 of the folding device in a view form the exterior. The opening wings 1 of the folding device in the illustrated embodiment open inwardly relative to the position of the viewer of FIG. 2. The opening wings 1 are comprised of double pane panels 7 framed in wing frames 5. The wings are slidably guided at the top and bottom in guide rails 8 by means of guide elements. The guide rails 8 according to the invention are provided at the outer side by a stop 18 across which the wings cannot move. However, the opening wings 1 have profiled strips 16 which are configured according to the invention so as to be slanted in a direction toward the free wing edge 3.

The configuration according to the invention is best illustrated in FIGS. 3 through 6. These Figures show the sequence of the opening action of the folding device in section wherein the opening wings 1 pivot about pivot axes 11 of their guide elements 10. For reducing or covering the gap, the opening wings 1 are provided at the side of the free wing edge 3 facing the stop 18 with profiled strips 16 which project by the width B1 and B2, respectively, past the pivot axis 11 of the guide element 10. The profiled strips 16 are slanted in a direction toward the free wing edge 3 at the side facing the stop 18 in order to prevent collision with the stop 18 when opening the wing of the folding device (see FIGS. 4 through 6). Preferably, this slanted portion 17, as illustrated, is formed as a rounded portion having a radius R originating at the pivot axis 11. The profiled strip 16 can be a monolithic part or unitary part of the free wing edge 3.

Figure 3:
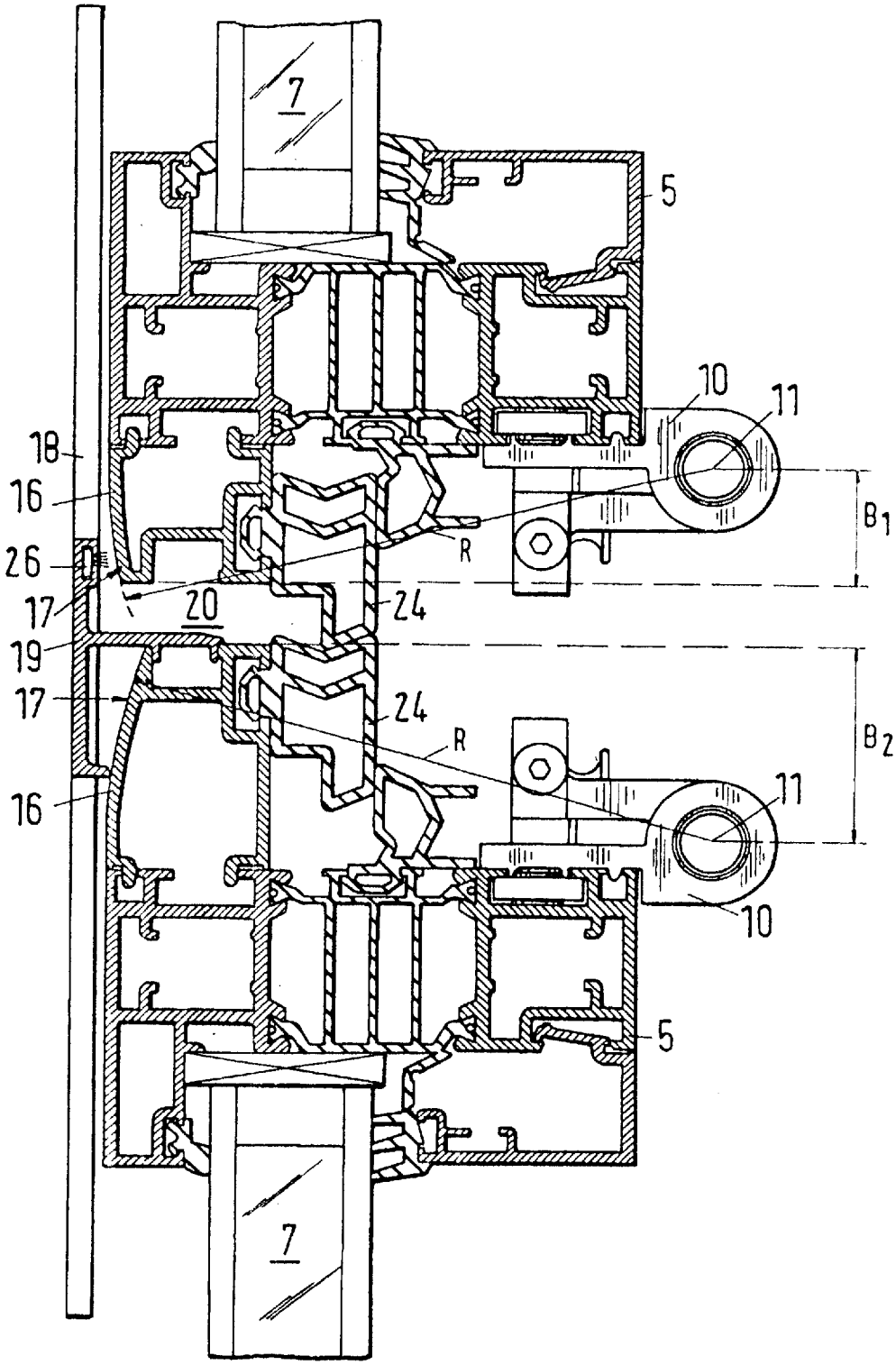
FIG. 3 is a section view in the direction III—III of the object of FIG. 2.
Figure 4:
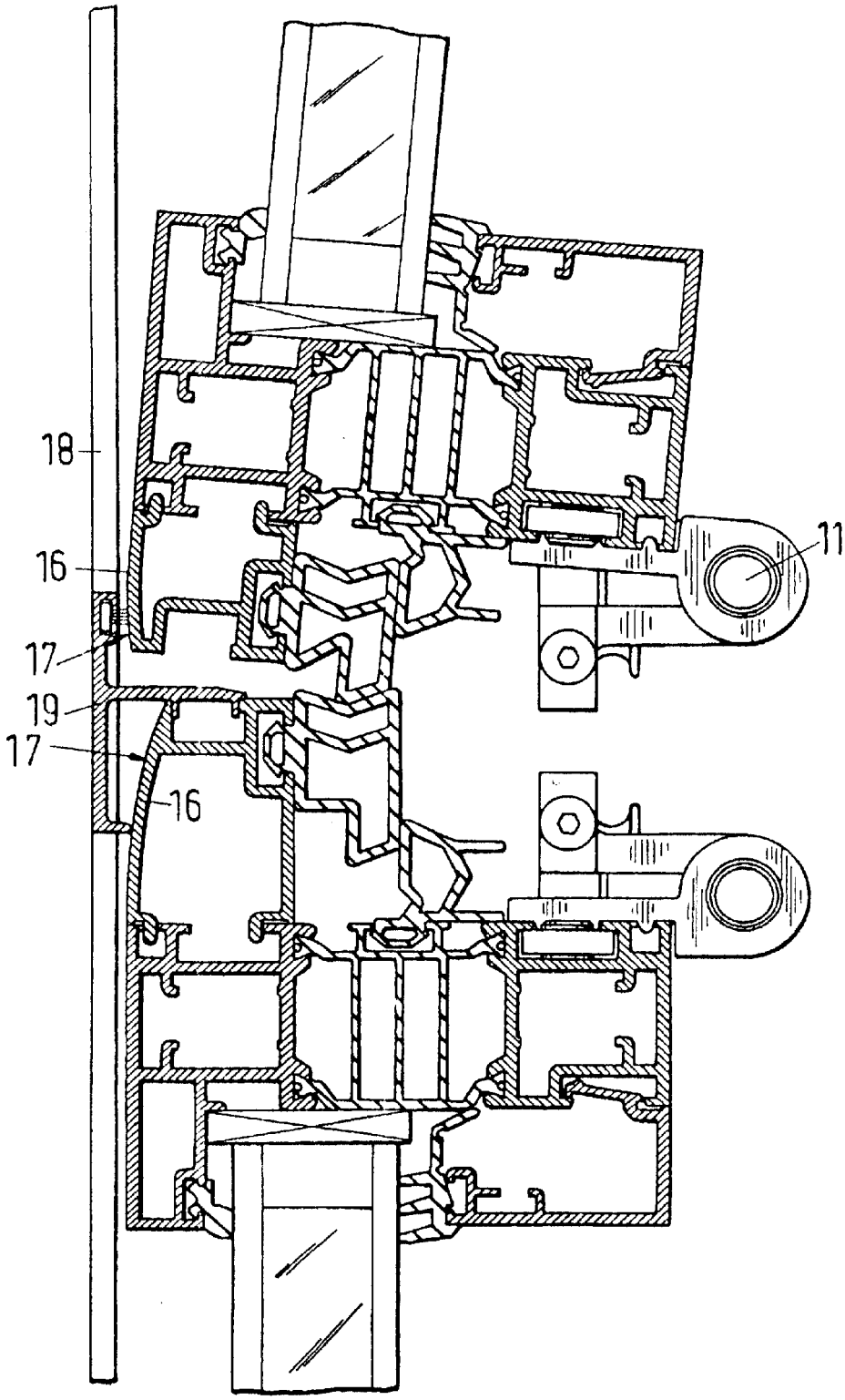
FIG. 4 shows the object of FIG. 3 in a first position when opening the wing.
Figure 5:
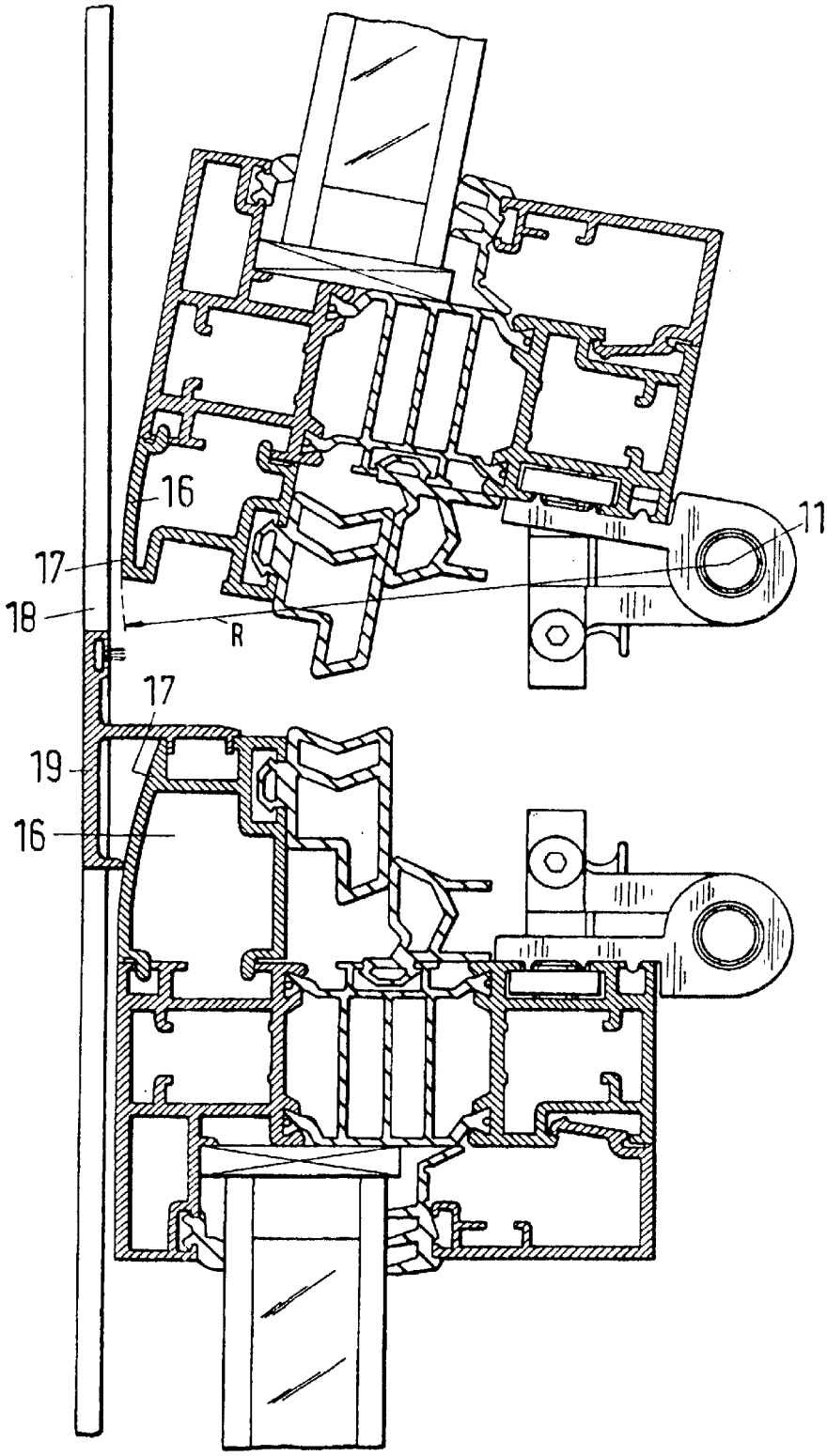
FIG. 5 shows the object of FIG. 3 in a second position when opening the wing.
Figure 6:
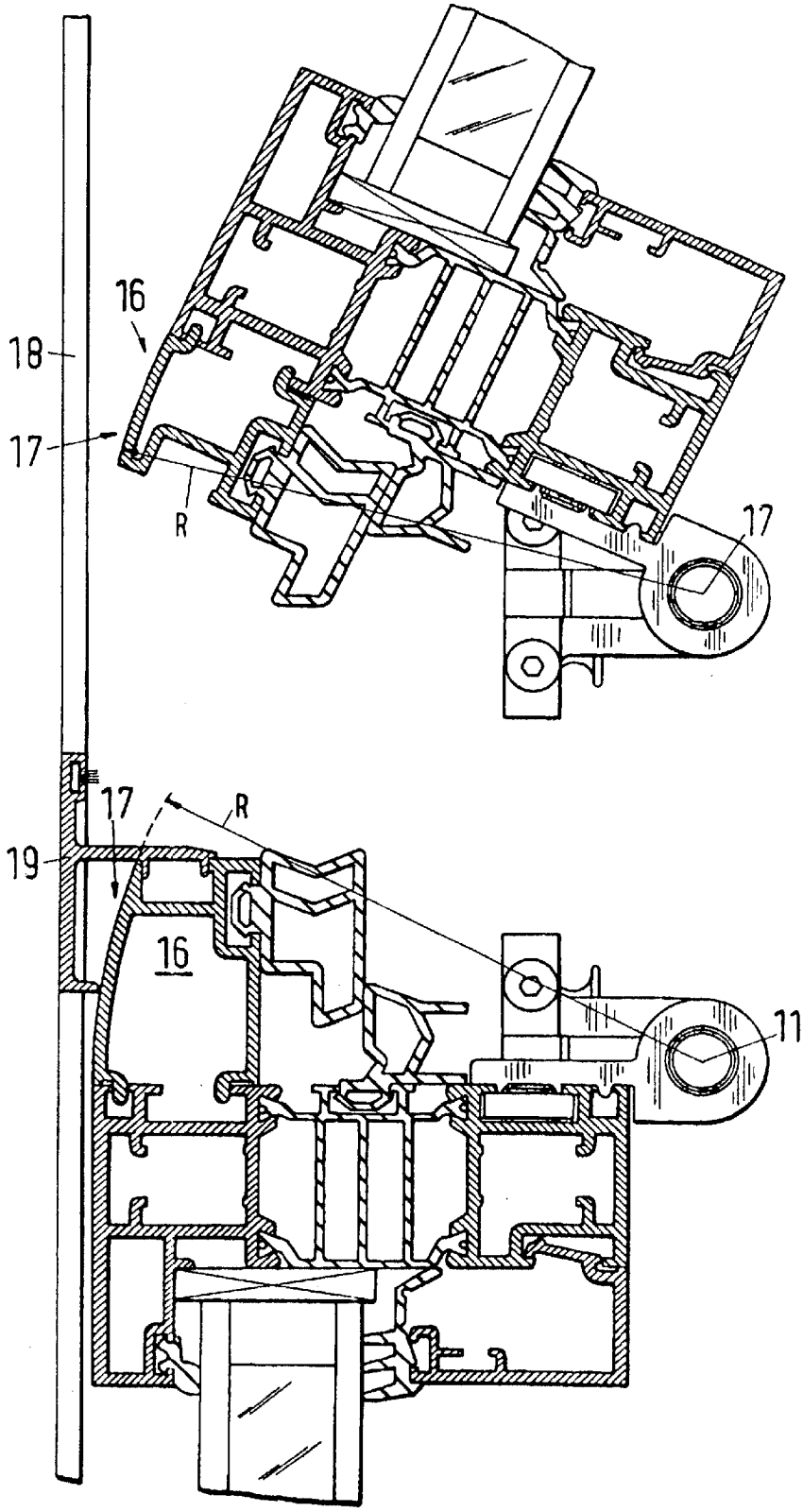
FIG. 6 shows the object of FIG. 3 in a third position when opening the wing.

As a result of the arrangement of the guide elements 10, the illustrated folding device has its greatest width not in the completely closed state according to FIG. 3 but in the slightly open state according to FIG. 4 when all guide elements 10 are aligned with one another. Upon opening of the folding device, the wing chain first becomes wider before the opening action actually takes place. This widening of the device upon opening is referred to as negative travel because the travel first occurs counter to the actual opening direction. In order to be able to compensate this negative travel, the profiled strips 16 of the illustrated device are configured such with regard to their widths B1 and B2 that they do not cover the gap between the opening wings 1 completely but leave a free space 20 which allows movement of the previously closed opening wing 1 in the direction of its free wing edge 3.

In order to ensure, despite the free space 20, the best possible draft protection, at least one of the free wing edges 3 should be provided with a flexible seal 24. In the illustrated embodiment both opening wings 1 have rubber seals 24 which, when the wings open, deform to compensate the negative travel as shown in FIG. 4.

In order to obtain even fewer points of attack for burglary tools and in order to obtain further improvement with regard to draft protection and visual appearance, at least one profiled strip 16 is provided with a cover strip 19 within the inner opening height between the stop 18 and the oppositely positioned guide rail (not illustrated) or a second stop possibly provided in the opposite guide rail. The cover strip 19 covers at least partially the slanted (or rounded) portion 17 of the profiled strip 16 as illustrated in FIGS. 2 and 3. When two opening wings 1 abut one another as in the illustrated embodiment, it is advantageous to provide the cover strip 19 only at one of the opening wings 1 and to design it to have such a width that it overlaps or covers also the profiled strip 16 of the neighboring opening wing 1. The cover strip 19 can also be formed as a monolithic or a unitary part of the profiled strip 16 to which it is secured. In order to improve draft protection even more, the cover strip 19 can be in the form of a brush seal 26 (as illustrated), a sealing lip or similar sealing means.

The folding device according to the invention is characterized in that it provides a high degree of burglary protection, excellent draft protection, and a uniform appealing visual appearance while ensuring an optimal technical function.

While specific embodiments of the invention have been shown and described in detail to illustrate the inventive principles, it will be understood that the invention may be embodied otherwise without departing from such principles.

What is claimed is:

1. A folding device as a room divider or room closure, comprising:

at least one wing chain comprised of wings pivotably connected to one another such that the wings upon opening of the folding device are folded against one another;

wherein the wings have guide elements (10) forming a pivot axis (11), respectively, for the wings, wherein the guide elements (10) are connected to one side of the wings, respectively, or the wings are pivotably secured on a lateral frame;

a first guide rail (8) and a second guide rail (8) receiving the guide elements (10) such that the wings are slidably guided in the first and second guide rails (8);

wherein at least one of the wings of the at least one wing chain is an opening wing (1) connected only to a single neighboring wing of the at least one wing chain and has a free wing edge (3) guided in the first and second guide rails (8);

wherein at least the first guide rail has a stop (18) on one longitudinal side, wherein the wings cannot move past the stop (18);

wherein the free wing edge (3) has a profiled strip (16) at a side facing the stop (18) and wherein the profiled strip (16) is immobile relative to the free wing edge (3);

wherein the profiled strip (16) projects past the pivot axis (11) of the guide element (10) provided at the free wing edge (3) and has a slanted portion (17) facing the stop (18) and slanted in a direction toward the free wing edge (3), wherein the slanted portion extends at least across a height (A) of the stop (18).

2. The folding device according to claim 1, wherein the slanted portion (17) is a rounded portion having a radius (R) originating at the pivot axis (14) of the guide element (10).

3. The folding device according to claim 1, wherein at least one of the profiled strips (16) of two of the opening wings (1) meeting one another in a closed position of the folding device has a cover strip (19) extending across an opening height of the folding device between the raised stop (18) and the second guide rail (8) or between the raised stop (18) and an additional raised stop provided on the second guide rail (8), wherein the cover strip (19) covers at least partially the slanted portion (17) of the profiled strip (16).

4. The folding device according to claim 3, wherein the cover strip (19) and the profiled strip (16) together form a monolithic part.

5. The folding device according to claim 3, wherein the cover strip (19), when the folding device is closed, covers also the profiled strip (16) of the neighboring opening wing (1).

6. The folding device according to claim 5, wherein the cover strip (19) and the profiled strip (16) of the neighboring opening wing (1) delimit a free space (20) allowing, when opening the folding device, a movement of the opening wing (1) away from a closed position in a direction toward the free wing edge (3).

7. The folding device according to claim 3, wherein at least one of the profiled strip (16) and the cover strip (19) has a seal (26) for sealing relative to the neighboring opening wing (1) in the closed position or the lateral frame (22).

8. The folding device according to claim 1, wherein the profiled strip (16) and the free wing edge (3) together are formed as a monolithic part.

* * * * *